US010196160B2

(12) United States Patent
Bonnain et al.

(10) Patent No.: US 10,196,160 B2
(45) Date of Patent: Feb. 5, 2019

(54) PACKAGING MACHINE AND METHOD OF PACKAGING ARTICLES

(71) Applicant: Westrock Packaging Systems, LLC, Norcross, GA (US)

(72) Inventors: Jean-Christophe Bonnain, Chateauroux (FR); Gerard Louret, Ardentes (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 428 days.

(21) Appl. No.: 14/914,478

(22) PCT Filed: Sep. 10, 2014

(86) PCT No.: PCT/US2014/054883
§ 371 (c)(1),
(2) Date: Feb. 25, 2016

(87) PCT Pub. No.: WO2015/038566
PCT Pub. Date: Mar. 19, 2015

(65) Prior Publication Data

US 2016/0200464 A1 Jul. 14, 2016

Related U.S. Application Data

(60) Provisional application No. 61/877,499, filed on Sep. 13, 2013.

(51) Int. Cl.
*B65B 5/02* (2006.01)
*B65B 5/10* (2006.01)
(Continued)

(52) U.S. Cl.
CPC ..... *B65B 5/10* (2013.01); *B65B 5/024* (2013.01); *B65B 5/106* (2013.01); *B65B 21/06* (2013.01);
(Continued)

(58) Field of Classification Search
CPC .. B65B 5/024; B65B 5/06; B65B 5/10; B65B 5/106; B65B 21/242; B65B 35/30;
(Continued)

(56) References Cited

U.S. PATENT DOCUMENTS 4,003,464 A * 1/1977 Zappia ..... B65G 47/82 198/430
4,815,251 A * 3/1989 Goodman ..... B65B 5/061 53/156
(Continued)

FOREIGN PATENT DOCUMENTS

CN 101489872 A 7/2009
CN 102083694 A 6/2011
(Continued)

*Primary Examiner* — Stephen F. Gerrity
(74) *Attorney, Agent, or Firm* — WestRock Intellectual Property Group

(57) ABSTRACT

A packaging machine for packaging articles into cartons includes a first conveyor for conveying cartons along a carton stream, a second conveyor for conveying first article groups adjacent to the carton stream, a third conveyor for conveying divider pads adjacent to the carton stream, and a fourth conveyor for conveying second article groups adjacent to the carton stream. A first lateral transfer mechanism transfers the first article groups transversely into cartons within the carton stream. A second lateral transfer mechanism transfers the divider pads transversely into the cartons within the carton stream and onto said first article groups contained therein. A third lateral transfer mechanism transfers the second article groups transversely into the cartons within the carton stream and onto the divider pads contained therein.

8 Claims, 2 Drawing Sheets

(51) Int. Cl.

| | |
|---|---|
| ***B65B 21/24*** | (2006.01) |
| ***B65B 35/30*** | (2006.01) |
| ***B65B 35/40*** | (2006.01) |
| ***B65B 35/54*** | (2006.01) |
| ***B65B 61/20*** | (2006.01) |
| ***B65B 21/06*** | (2006.01) |

(52) U.S. Cl.
CPC ..... *B65B 21/242* (2013.01); *B65B 35/30* (2013.01); *B65B 35/40* (2013.01); *B65B 35/54* (2013.01); *B65B 61/207* (2013.01)

(58) Field of Classification Search
CPC ..... B65B 35/40; B65B 35/54; B65B 61/207; B65B 21/06
USPC ..... 53/445, 456, 458, 474, 157, 534, 537, 53/566, 251, 252
See application file for complete search history.

(56) References Cited

U.S. PATENT DOCUMENTS 4,938,656 A * 7/1990 Gamberini et al. .. B65B 61/207 414/789.5
5,214,901 A * 6/1993 Milliner ..... B65B 61/207 53/136.1
5,469,687 A * 11/1995 Olson ..... B65B 17/025 53/134.1
5,727,365 A * 3/1998 Lashyro et al. ..... B65B 5/024 53/157
5,755,075 A * 5/1998 Culpepper ..... B65B 61/207 53/157
5,758,474 A * 6/1998 Ziegler ..... B65B 5/106 53/153
5,761,882 A * 6/1998 Gambetti ..... B65B 61/207 53/157
6,058,679 A * 5/2000 Ziegler et al. ..... B65B 5/024 53/447
6,711,878 B1 * 3/2004 Paselsky et al. ..... B65B 5/106 53/237
2001/0029723 A1 10/2001 Ziegler et al.
2009/0313953 A1 * 12/2009 Disrud ..... B65B 5/06 53/475
2011/0154784 A1 * 6/2011 Poutot ..... B65B 5/024 53/443
2018/0265234 A1 * 9/2018 Sassi ..... B65B 35/38

FOREIGN PATENT DOCUMENTS

CN 102083695 A 6/2011
CN 102365205 A 2/2012
DE 9408979 U1 * 7/1995 ..... B65B 35/40
DE 102009022820 * 12/2010 ..... B65B 35/54
EP 1359099 A2 * 11/2003 ..... B65B 35/54
WO WO 9420368 A1 * 9/1994 ..... B65B 5/106
WO WO 95/07839 A1 3/1995
WO WO95/07839 A1 3/1995
WO WO 2010/111579 A1 9/2010
WO WO 2012121762 A1 * 9/2012 ..... B65B 35/40

* cited by examiner

PACKAGING MACHINE AND METHOD OF PACKAGING ARTICLES

FIELD OF THE INVENTION

The present invention relates to a packaging machine and a method of packaging articles. More particularly, but not exclusively, the invention relates to a method of manipulating articles in a stream of articles and an apparatus for carrying out the method and to a packaging machine having a layout which is capable of processing multiple carton types and formats.

BACKGROUND OF THE INVENTION

In the field of packaging it is often required to provide consumers with a package comprising multiple primary product containers, such multi-packs being desirable for shipping and distribution and for display of promotional information.

It is known to automate packaging of the primary product containers into the package by placing the primary product containers into a carton formed from a carton blank.

It is also desirable to produce packaging machine which can be coupled to the output of a processing machine which places product into the primary product containers; for example, this may be a bottling or canning machine. It may be further desirable to reorganise the output stream of primary product containers to facilitate placement into cartons.

It is further desirable to provide a packaging machine having a layout which is capable of processing a variety of different carton formats, for example, wrap around cartons, basket carriers, or fully enclosed cartons, and to be able to side or end load, top load or bottom load the chosen carton format with primary product containers. In one particular example, it is desirable that such a machine be able to process cartons having product containers arranged in two or more layers. Furthermore it is desirable to be able to rapidly change the format or layout of the packaging machine to adapt to the carton format or loading method required.

SUMMARY OF INVENTION

According to a first aspect of the present invention, there is provided a packaging machine for packaging articles into cartons, which system includes a first conveyor for conveying cartons along a carton stream, a second conveyor for conveying first article groups to form a first stream of article groups adjacent to the carton stream, a third conveyor for conveying divider pads to form a divider pad stream adjacent to the carton stream, and a fourth conveyor for conveying second article groups to form a second stream of article groups adjacent to the carton stream. A first lateral transfer mechanism is provided for transferring the first article groups in a direction substantially transverse to the first stream of article groups into cartons within the carton stream. A second lateral transfer mechanism transfers the divider pads in a direction substantially transverse to the divider pad stream into the cartons within the carton stream and onto the first article groups contained therein. A third lateral transfer mechanism transfers the second article groups in a direction substantially transverse to the second stream of article groups into the cartons within the carton stream and onto the divider pads contained therein.

Within such a packaging machine, the first lateral transfer mechanism, the second lateral transfer mechanism, and the third lateral transfer mechanism may all be operable to transfer article groups and divider pads while the first conveyor is in continuous motion.

The second and fourth conveyors may be disposed adjacent the first conveyor along a first side of the first conveyor. The third conveyor may be disposed adjacent the first conveyor along a second, opposite side of the first conveyor.

According to another aspect of the present invention, a method for packaging articles into cartons includes the steps of conveying cartons along a carton stream, conveying first article groups to form a first stream of article groups adjacent to the carton stream, conveying divider pads to form a divider pad stream adjacent to the carton stream, and conveying second article groups to form a second stream of article groups adjacent to the carton stream. The method may further include laterally transferring the first article groups in a direction substantially transverse to the first stream of article groups into cartons within the carton stream, laterally transferring the divider pads in a direction substantially transverse to the divider pad stream into the cartons within the carton stream and onto the first article groups contained therein, and laterally transferring the second article groups in a direction substantially transverse to the second stream of article groups into the cartons within the carton stream and onto the divider pads contained therein.

Within such a method, the steps of laterally transferring the first article groups, the divider pads, and the second article groups may all be performed while the cartons are conveyed along the carton stream in continuous motion.

At least a portion of the first stream of article groups and the second stream of article groups may extend along a first side of the carton stream. At least a portion of the divider pad stream may extend along a second, opposite side of the carton stream.

BRIEF DESCRIPTION OF THE DRAWINGS

Exemplary embodiments of the invention will now be described with reference to the accompanying drawings.

DETAILED DESCRIPTION OF EXEMPLARY EMBODIMENTS OF THE PRESENT INVENTION

Figure 1A:
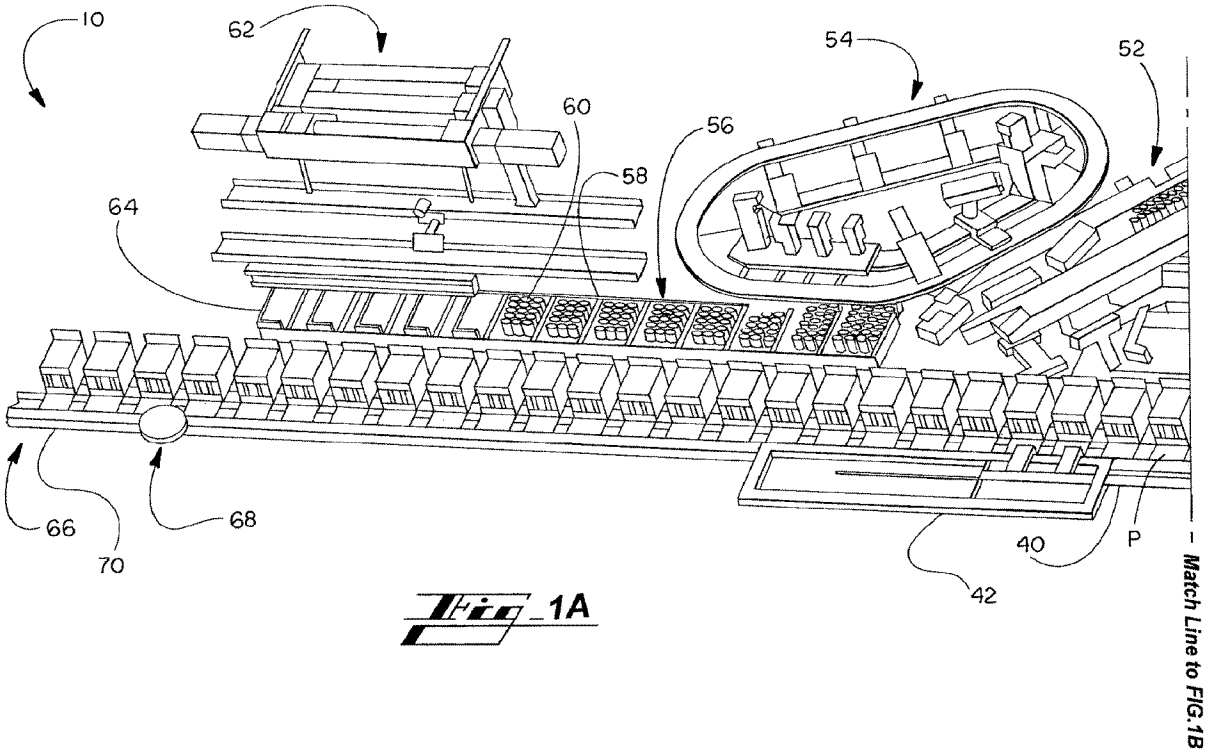
FIGS. 1A and 1B show a split perspective view from above of a packaging machine according to an embodiment of the this disclosure.
Figure 1B:
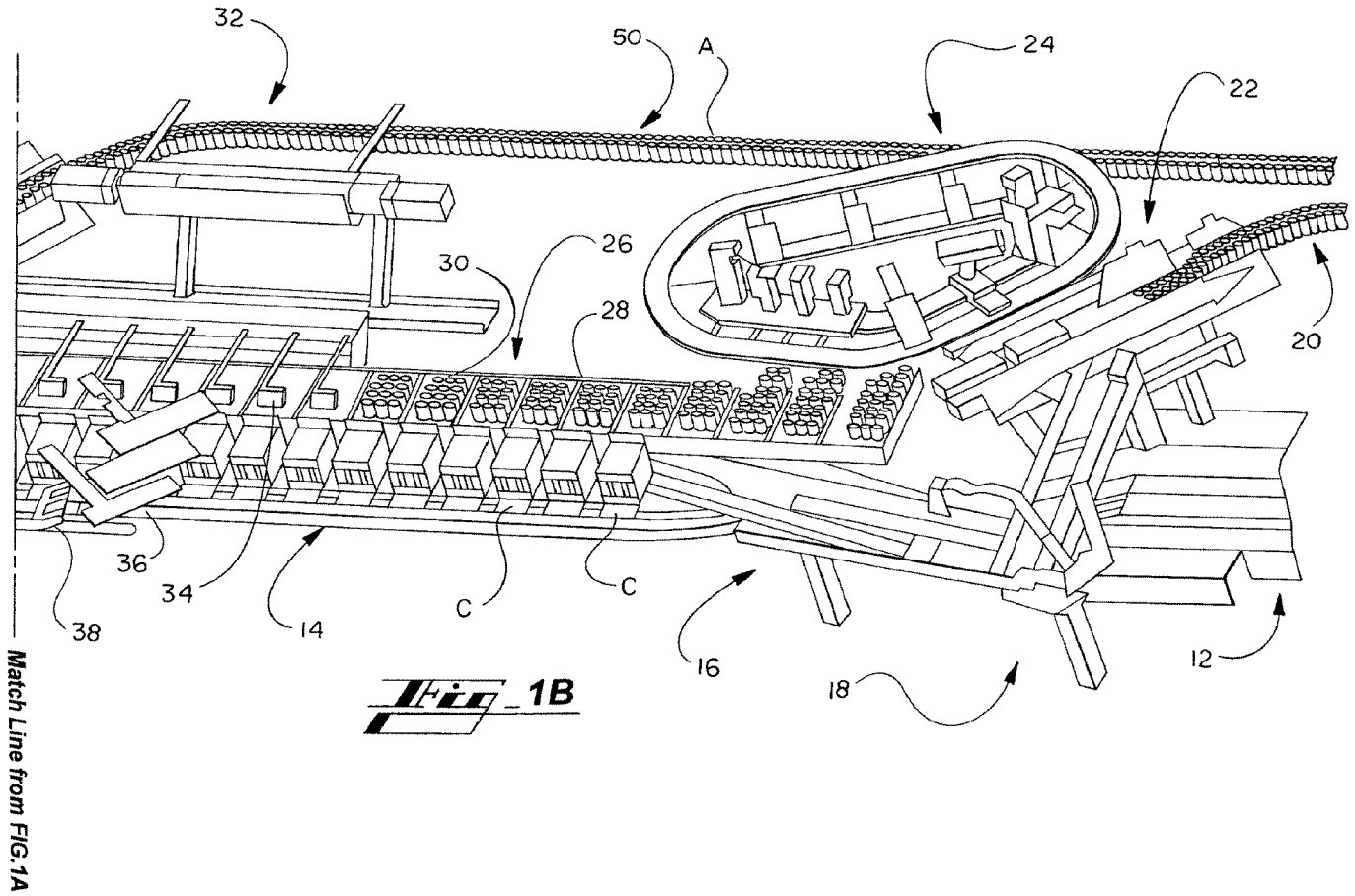

FIGS. 1A and 1B show a split perspective view of a packaging machine 10 capable of accepting an input of primary products such as, but not limited to, cans for beverages or similar products, hereinafter referred to as articles.

Carton blanks (not shown) are stored in a hopper or magazine 12 and transferred from the hopper 12 to a first conveyor or carton conveyor 14 via a pre-former 16 by a carton blank feeder mechanism 18. The carton blank feeder mechanism 18 picks up a carton blank from the hopper 12, and the carton blank is pushed into the pre-former 16 by the carton blank feeder mechanism 18. The pre-former 16 forces the side panels and end panels of the carton blank to be folded into a substantially perpendicular relationship to one another and to a base panel of the carton blank, thus partially forming a carton C from the carton blank. The partially formed carton C is capable of receiving articles prior to completing assembly of the carton C. In accordance with one embodiment of the invention, the carton is of a height capable of accommodating articles in two stacked tiers. In such a case, the side panels of such a carton have a height of approximately twice the height of an individual article.

Articles A are transferred in a first stream to the input end of the packaging machine 10 on a first input conveyor 20. First input conveyor 20 delivers the articles to a regulator 22 used to space groups of articles A from the incoming stream of articles A and to control the pitch between groups of articles A as they are conveyed. After the incoming stream of articles A is regulated, the groups are acted upon by a robotic rotating and transfer mechanism 24 that picks up a group of articles A from the stream. In the illustrated embodiment, eight articles in a 4×2 array are successively lifted from the output end of the input conveyor, rotated and placed onto a second conveyor 26. This processing is shown in more detail in PCT Published Application WO2009/114332, published Nov. 12, 2009, which is hereby incorporated by reference. Second conveyor 26 is provided with a series of flight bars 28 to restrain the articles in groups of a different configuration than those formed by regulator 22. In particular, as each group is rotated, it is placed on second conveyor 26 in a transverse direction. Further, every other transferred group is placed so as to straddle a flight bar 28. Thus, the newly formed groups 30 are provided on second conveyor 26 in a 3×4 array, each located between successive pairs of flight bars 28.

Second conveyor 26 is operated at a speed that is synchronized with first conveyor 14, whereby each group 30 is aligned with the open end of a carton C. A first lateral transfer mechanism 32 is disposed near the end of second conveyor 26, and is capable of motion in the machine direction, the transverse direction, and vertically with respect to machine 10. First lateral transfer mechanism 32 is equipped with a plurality of pusher devices 34, each spaced from the next at a distance corresponding to that between successive groups 30 of articles A.

The pusher elements 34 are moved by first lateral transfer device 32 in a longitudinal direction at a speed that is synchronized with the speed of first and second conveyors 14 and 26, and are aligned with the groups 30. Simultaneously with the longitudinal motion, the pusher devices 34 are moved laterally across second conveyor 26, thereby pushing the associated groups 30 into the open ends of corresponding cartons C. After the groups have been fully pushed into the cartons, the first lateral transfer device 32 raises the pusher devices 34 above second conveyor 26 and aligns the pusher devices with the next succeeding ones of groups 30.

In loading a carton with articles arranged in two or more tiers, it is known in the art to place a divider pad of paperboard or the like between the tiers. A hopper 36 holds a supply of pads (not shown), and a pad feeding mechanism 38 is provided to withdraw successive pads and place each pad P onto a third conveyor 40. Third conveyor 40 is operated in synchronous motion with first conveyor 14 such that a pad P is aligned with each carton C moving along the first conveyor 14. A second lateral transfer mechanism 42 is positioned adjacent and/or above third conveyor 40, and acts to laterally transfer each pad P into the adjacent carton C while both pad and carton are in motion. The pad P is placed into the carton C on top of the first group of articles previously placed into the carton by the first lateral transfer mechanism 32.

Additional articles A are transferred in a second stream to the input end of the packaging machine 10 on a second input conveyor 50. Second input conveyor 50 delivers the articles to a second regulator 52 used to space groups of articles A from the article stream and to control the pitch between groups of articles A as they are conveyed. After the incoming stream of articles A is regulated, the groups are acted upon by second robotic rotating and transfer mechanism 54 that may be similar to first robotic rotating and transfer mechanism 24. In the illustrated embodiment, mechanism 54 also lifts eight articles in a 4×2 array from the output end of second input conveyor 50, and rotates and places each group onto a fourth conveyor 56. Fourth conveyor 56 is provided with a series of flight bars 58 to restrain the articles in groups of a 3×4 configuration similar to what is done on second conveyor 26. In particular, as each group is rotated, the newly formed groups 60 are placed on second conveyor 56 in a 3×4 array, each located between successive pairs of flight bars 58.

Fourth conveyor 56 is operated at a speed that is synchronized with first conveyor 14, whereby each group 60 is aligned with the open end of a carton C. Further, fourth conveyor 60 may be located at a vertical elevation that corresponds to the surface of the pads P that are disposed within cartons C downstream from the second lateral transfer mechanism 42. A third lateral transfer mechanism 62 is disposed near the end of fourth conveyor 56, and may be of similar construction and function to first lateral transfer mechanism 32. Third lateral transfer mechanism 62 is equipped with a plurality of pusher devices 64, each spaced from the next at a distance corresponding to that between successive groups 60 of articles A.

The pusher elements 64 are moved by third lateral transfer device 62 in a longitudinal direction at a speed that is synchronized with the speed of first and fourth conveyors 14 and 56, and are aligned with the groups 60. Simultaneously with the longitudinal motion, the pusher devices 64 are moved laterally across fourth conveyor 56, thereby pushing the associated groups 60 into the open ends of corresponding cartons C and on top of the first article group and pad already located within the carton. After the second groups have been fully pushed into the cartons, the third lateral transfer device 62 raises the pusher devices 64 above fourth conveyor 56 and aligns the pusher devices with the next succeeding ones of groups 60.

After the upper group of articles has been loaded into each carton, the cartons are moved by first conveyor 14 into a carton closing and gluing section 66. Closing and gluing section 66 may be of a conventional design, and may include one or more glue guns (not shown) for the application of glue to the carton end flaps, one or more folding wheels and/or fixed guides to close the carton end flaps (see e.g. folding wheel 68; other components not shown), and a compression device 70 for holding the flaps in a closed condition until the glue has set. The completed, loaded cartons are then conveyed out of machine 10. In the embodiment described herein, such cartons contain twenty-four articles, arranged in two tiers of 3×4 articles each.

While the machine 10 may be used to load cartons with articles in a two-tier arrangement, it will be recognised that additional tiers may be provided with the addition of further mechanisms for handling additional infeed streams of articles.

It will also be recognised that machine 10 may be operated to produce cartons having only a single tier of articles contained therein. In such a case, one, some or all portions of the devices and mechanisms for handling the incoming stream of articles for one tier of articles may be disabled, and the machine 10 otherwise operated in a normal manner to arrange and load articles in only a single tier.

The invention claimed is:

1. A packaging machine for packaging articles into cartons, which system comprises:

a first conveyor for conveying cartons along a carton stream;

a second conveyor for conveying first article groups to form a first stream of article groups adjacent to said carton stream;

a third conveyor for conveying divider pads to form a divider pad stream adjacent to said carton stream;

a fourth conveyor for conveying second article groups to form a second stream of article groups adjacent to said carton stream;

a first lateral transfer mechanism for transferring said first article groups in a direction substantially transverse to the first stream of article groups into cartons within said carton stream, the first lateral transfer mechanism including a plurality of pusher devices spaced apart at a distance corresponding to a distance between successive first article groups, wherein the first lateral transfer mechanism is configured to align each of the pusher devices with an associated first article group, wherein the first lateral transfer mechanism is configured to move the pusher devices in a longitudinal direction at a speed that is synchronized with the speed of first and second conveyors, wherein, simultaneously with the longitudinal motion, wherein the first lateral transfer mechanism is configured to move the pusher devices transverse across second conveyor thereby pushing each associated first article group into an open end of a corresponding carton, and wherein the first lateral transfer device is configured to raise the pusher devices above the second conveyor and realign the pusher devices with succeeding associated first article groups;

a second lateral transfer mechanism for transferring said divider pads in a direction substantially transverse to the divider pad stream into said cartons within said carton stream and onto said first article groups contained therein; and a third lateral transfer mechanism for transferring said second article groups in a direction substantially transverse to the second stream of article groups into said cartons within said carton stream and onto said divider pads contained therein.

2. The packaging machine of claim 1 wherein said first lateral transfer mechanism, said second lateral transfer mechanism, and said third lateral transfer mechanism are all operable to transfer article groups and divider pads respectively while said first conveyor is in continuous motion.

3. The packaging machine of claim 1 wherein said second and fourth conveyors are disposed adjacent said first conveyor along a first side of said first conveyor.

4. The packaging machine of claim 3 wherein said third conveyor is disposed adjacent said first conveyor along a second side of said first conveyor.

5. A method for packaging articles into cartons, comprising:

conveying cartons along a carton stream;

conveying first article groups to form a first stream of first article groups adjacent to said carton stream;

conveying divider pads to form a divider pad stream adjacent to said carton stream;

conveying second article groups to form a second stream of second article groups adjacent to said carton stream;

laterally transferring-said first article groups in a direction substantially transverse to the first stream of article groups into cartons within said carton stream, using a first lateral transfer mechanism having a plurality of pusher devices spaced apart at a distance corresponding to a distance between successive first article groups, wherein using the first lateral transfer device includes:

aligning each of the pusher devices with an associated first article group;

moving the pusher devices in a longitudinal direction at a speed that is synchronized with the speed of first and second conveyors;

moving the pusher devices transverse across second conveyor, simultaneously with the longitudinal motion, thereby pushing each associated first article group into an open end of a corresponding carton;

raising the pusher devices above the second conveyor; and realigning the pusher devices with succeeding associated first article groups;

laterally transferring said divider pads in a direction substantially transverse to the divider pad stream into said cartons within said carton stream and onto said first article groups contained therein; and laterally transferring said second article groups in a direction substantially transverse to the second stream of article groups into said cartons within said carton stream and onto said divider pads contained therein.

6. The method of claim 5 wherein the steps of laterally transferring said first article group, said divider pads, and said second article groups are all performed while said cartons conveyed along said carton stream are in continuous motion.

7. The method of claim 6 wherein at least a portion of said first stream of article groups and said second stream of article groups extend along a first side of said carton stream.

8. The method of claim 7 wherein at least a portion of said divider pad stream extends along a second side of said carton stream.

* * * * *